US008726593B2

(12) United States Patent
Krenz

(10) Patent No.: US 8,726,593 B2
(45) Date of Patent: May 20, 2014

(54) VENTILATION STRIP, IN PARTICULAR FOR HIGH-PITCHED ROOFS

(75) Inventor: Michael Krenz, Rockenberg (DE)

(73) Assignee: Monier Roofing Components GmbH (DE)

( * ) Notice: Subject to any disclaimer, the term of this patent is extended or adjusted under 35 U.S.C. 154(b) by 407 days.

(21) Appl. No.: 12/600,968

(22) PCT Filed: Jun. 5, 2007

(86) PCT No.: PCT/EP2007/004981
§ 371 (c)(1),
(2), (4) Date: Nov. 19, 2009

(87) PCT Pub. No.: WO2008/148408
PCT Pub. Date: Dec. 11, 2008

(65) Prior Publication Data
US 2010/0154337 A1 Jun. 24, 2010

(51) Int. Cl.
*E04B 7/00* (2006.01)
*E04B 1/70* (2006.01)

(52) U.S. Cl.
USPC ..... 52/302.3; 52/302.6; 52/57; 52/95; 52/198

(58) Field of Classification Search
USPC ..... 454/359, 364, 365; 52/198, 199, 95, 57, 52/302.1, 302.3, 302.6
See application file for complete search history.

(56) References Cited

U.S. PATENT DOCUMENTS 4,558,637 A * 12/1985 Mason ..... 454/365
4,676,147 A * 6/1987 Mankowski ..... 454/365
4,817,506 A * 4/1989 Cashman ..... 454/365
5,050,489 A * 9/1991 Mankowski ..... 454/365
5,092,225 A 3/1992 Sells
5,094,041 A 3/1992 Kasner et al.
5,112,278 A * 5/1992 Roberts ..... 454/365
5,328,407 A * 7/1994 Sells ..... 454/365
5,603,657 A 2/1997 Sells
5,803,805 A 9/1998 Sells (Continued)

FOREIGN PATENT DOCUMENTS

DE 23 56 782 5/1975
EP 791699 A1 * 8/1997 ..... E04D 13/17

(Continued)

OTHER PUBLICATIONS

Ukrainian Office Action issued Sep. 7, 2010 in connection with corresponding Ukrainian Patent Application No. 2009 10419 with English language summary.

(Continued)

*Primary Examiner* — Elizabeth A Plummer
(74) *Attorney, Agent, or Firm* — Ostrolenk Faber LLP

(57) ABSTRACT

The invention relates to a venting band with at least two side strips extending parallel to one another and a center strip. Parallel to the side strips extend venting bands formed by continuously connected walls or webs. The venting bands can therein have diverse forms. At least one venting channel is provided; however, it is also possible to provide several venting channels. Through the use of certain materials with restoring forces for the venting band, the at least one venting channel can open automatically during the rolling out of the venting band. However, it is also possible, to bring about an opening of the at least one venting channel by pulling on the side strips.

24 Claims, 9 Drawing Sheets

(56) References Cited

U.S. PATENT DOCUMENTS

| | | | | |
|---|---|---|---|---|
| 5,921,863 | A * | 7/1999 | Sells | 454/359 |
| 5,947,817 | A * | 9/1999 | Morris et al. | 454/365 |
| 6,913,530 | B2 * | 7/2005 | Morris et al. | 454/365 |
| 6,959,519 | B2 * | 11/2005 | Adriaansen | 52/537 |
| 6,991,535 | B2 * | 1/2006 | Ciepliski et al. | 454/365 |
| 7,124,542 | B2 | 10/2006 | Hofmann | |
| 7,485,034 | B2 * | 2/2009 | Sells | 454/365 |
| 7,892,077 | B2 * | 2/2011 | Sattler et al. | 454/365 |
| 7,992,356 | B2 * | 8/2011 | Grossman et al. | 52/192 |
| 8,322,089 | B2 * | 12/2012 | Railkar et al. | 52/198 |
| 2005/0054284 | A1 | 3/2005 | Ciepliski et al. | |
| 2005/0166480 | A1 | 8/2005 | Sattler et al. | |
| 2013/0042543 | A1 * | 2/2013 | Letts et al. | 52/95 |
| 2013/0074428 | A1 * | 3/2013 | Allen et al. | 52/173.3 |

FOREIGN PATENT DOCUMENTS

| | | |
|---|---|---|
| EP | 1 260 650 | 11/2002 |
| EP | 1 284 330 | 2/2003 |
| GB | 2155516 | 9/1985 |
| JP | 2001-323618 | 11/2001 |
| UA | 76 904 | 9/2006 |
| WO | 2004/022878 | 3/2004 |

OTHER PUBLICATIONS

International Search Report with English language translation and Written Opinion.

International Preliminary Report on Patentability issued Jan. 12, 2010 in corresponding International Application No. PCT/EP2007/004981.

English language translation of Written Opinion.

* cited by examiner

VENTILATION STRIP, IN PARTICULAR FOR HIGH-PITCHED ROOFS

CROSS-REFERENCE TO RELATED APPLICATION

The present application is a 35 U.S.C. §371 national phase conversion of PCT/EP2007/004981 filed Jun. 5, 2007, incorporated herein in its entirety.

BACKGROUND

1. Technical Field

The invention relates to a ventilation strip, in particular for high-pitched roofs.

2. Background Art

Venting bands are often employed for sealing a gap between ridge- or hip-battens of a pitched roof. As a rule they are formed as rolls which are unrolled on a ridge- or hip-batten.

Such venting bands serve, for one, to prevent the penetration of water, snow or vermin into the interior of the roof, however, on the other hand also to vent the space under the roof such that, for example, condensation water or rot or mold and mildew do not form. Known venting bands do not meet all of these requirements. If they deter water, snow and vermin, they often are not sufficiently permeable to air.

A venting band is already known which is comprised of a center strip and two side strips, the side portions having through-holes (U.S. Pat. No. 5,094,041). The side portions can be comprised of pieces disposed one above the other in the manner of an accordion.

A venting band with a center strip and two side strips is furthermore known, whose center strip has through-holes (GB 2,155,516 A). On the side strips are located ventilating strips, disposed substantially perpendicularly, which are provided with through-holes.

Further is known a ridge- or hip-batten sealing strip with ventilating function, which is comprised of a strip that is corrugated at the margins and in the center is air permeable (EP 1 260 650 A2). This strip includes cutouts provided in its center, extending transversely to the strip and closed by joining the edges extending in the transverse direction.

A venting element for a roof space is furthermore known, which includes several ventilating walls which are disposed between an upper and a lower plate (JP 2001 323618 A). These ventilating walls are disposed perpendicularly or obliquely and include several holes. However, this venting element cannot be wound into a roll.

The invention addresses the problem of providing a venting band which ensures high air exchange without water, snow or vermin penetrating through this venting band.

SUMMARY

This problem is solved as described herein.

The invention consequently relates to a venting band with at least two side strips extending parallel to one another and a center strip. Parallel to the side strips extend venting bands, which are formed by walls or webs connected continuously with one another. The venting bands can therein have the most diverse forms. At least one venting channel is provided. However, it is also possible to provide several venting channels. By utilizing certain materials for the venting band which have restoring forces, the at least one venting channel can open automatically when rolling out the venting band. However, it is also possible to effect the opening of the at least one venting channel by pulling on the side strips.

The advantage obtained with the invention comprises in particular that a rollable venting band comprises venting opening with good venting properties of the plane beneath a roof skin, these venting openings being secured against driving rain and blowing and drifting snow and the like. Penetration of driving rain and blowing snow is prevented through one channel or through several channels, which are comprised of breatheable or dense materials with through-holes. The venting region can here be either geometrically permanently open or only afterwards, i.e. after the venting band has been rolled out, form the channel or the channels. Through the invention several venting planes are formed, which are either disposed laterally one next to the other or be disposed offset one above the other in the installation position. Each additional venting plane represents herein a further hindrance against the penetration of driving rain. Drainage channels in all planes, except the innermost one, ensure that the water flows off outwardly in the potentially available intermediate planes.

Other features and advantages will become apparent from the following description of embodiments, which refers to the accompanying drawings.

BRIEF DESCRIPTION OF THE DRAWINGS

Embodiment examples of the invention are depicted in the drawings and will be described in the following in further detail.

DETAILED DESCRIPTION

Figure 1:
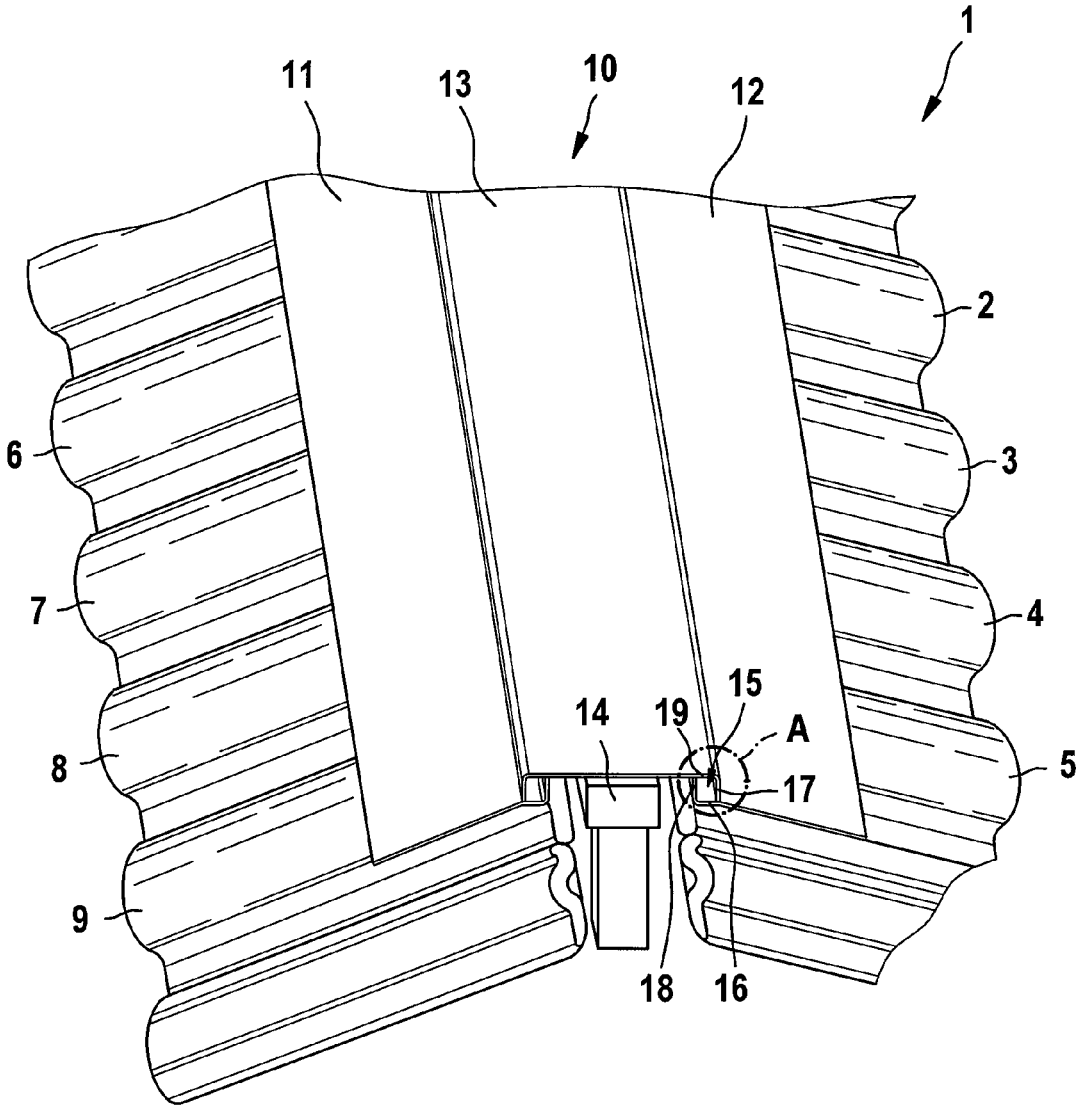
FIG. 1 a venting band according to the invention which has been laid out on a roof ridge, FIG. 2 a lateral view of the venting band according to FIG. 1, FIG. 3 an enlarged illustration of a partial region of the venting band according to FIG. 1, FIG. 4*a* a top view onto another embodiment of the venting band according to the invention, FIG. 4*b* a perspective view of the front side of the venting band according to FIG. 4*a*, FIG. 5 a view onto the front side of a further embodiment of the invention, FIG. 6 a perspective side view onto the venting band according to FIG. 5, FIG. 7 a perspective view onto a further embodiment of a venting band according to the invention, FIG. 8 a perspective view onto an embodiment of the invention with two venting channels, FIG. 9 a variant of the venting band depicted in FIG. 8, FIG. 10 a venting band laid out on a roof ridge over which is placed a ridge tile, FIG. 11 a perspective illustration of the device depicted in FIG. 10, FIG. 12 a segment from the eaves region of a pitched roof, FIG. 13 an enlarged segment from FIG. 12 with a venting band, FIG. 14 a folded venting band which substantially corresponds to the venting band according to FIG. 5, FIG. 15 the venting band according to FIG. 14 in the semi-upright state, FIG. 16 the venting band according to FIG. 14 in the completely upright state, FIG. 17 a venting band with spring element in the nearly folded state, FIG. 18 the venting band according to FIG. 17 in the folded-open state, FIG. 19 a spring element of the venting band according to FIG. 17 or FIG. 18, a partially rolled-up venting band according to FIG. 13.

FIG. 1 shows a roof ridge 1 with roof tiles 2, 3, 4, 5, 6, 7, 8, 9 and a venting band 10 according to the invention, which comprises two side strips 11, 12 and a center strip 13. The side strips 11, 12 are in contact on the roof tiles 2 to 9, while the center strip 13 rests on a ridge batten 14. The side strips 11, 12 are comprised of a plastically deformable material—or include such at least at their end—such that they adapt to the form of the roof tiles 2 to 9. This is not shown in FIG. 1.

In the following only the right region of the venting band 10 is described since the left region is structured like the right and is mirror-symmetric with respect to it.

Between the side strips 11, 12 and the center strip 13 a venting channel 15 is provided, which has a rectangular shape formed by four walls 16, 17, 18, 19. In the walls 17 and 18 are through-holes, not evident in FIG. 1. While the wall 19 is formed by the center strip 13, the wall 16 is formed by the side strips. Wall 18 can also be a portion of the side strip 12. Similar applies to wall 17, which can represent a continuation of the center strip 13.

Figure 2:
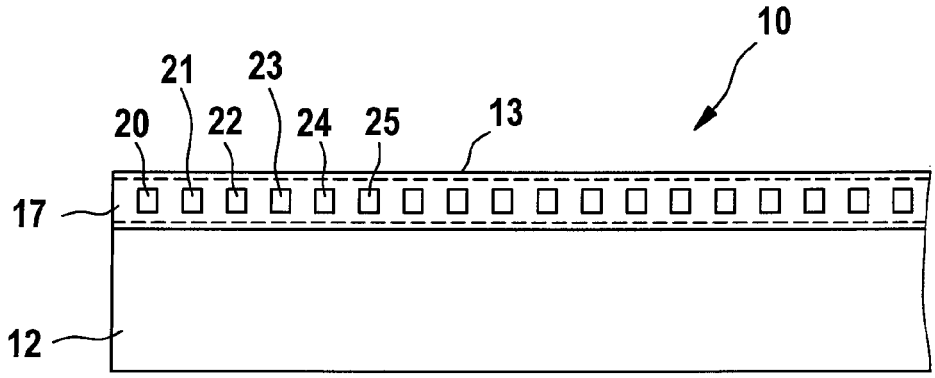

FIG. 2 shows a side view of the venting band 10 according to FIG. 1. Evident is herein the side strip 12 as well as the center strip 13. In wall 17 are provided several through-holes 20 to 25. The through-holes in the opposite wall 18 are not evident in FIG. 2.

Figure 3:
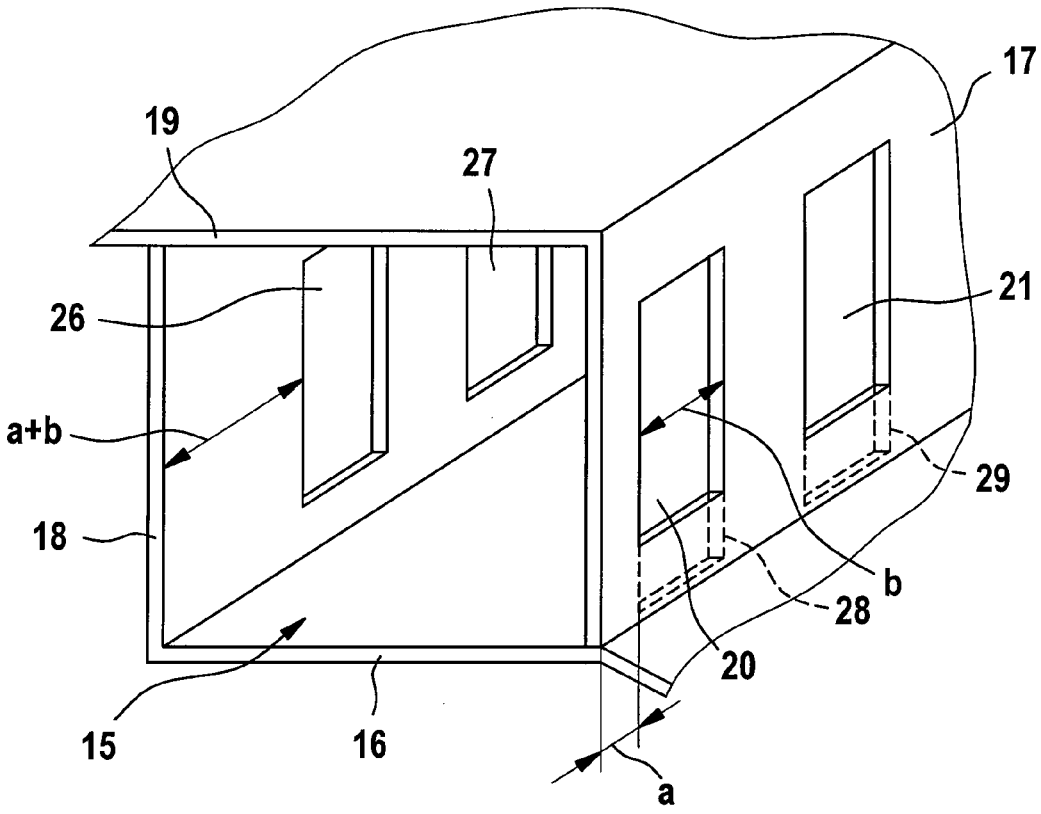

The venting channel 15, formed by walls 16 to 19, is shown at an enlarged scale in FIG. 3. This is the region identified in FIG. 1 by "A". The through-holes 20, 21 provided in wall 17 are evident as well as the through-holes 26, 27 provided in wall 18. The through-holes 26 and 27 are offset with respect to through-holes 20, 21 by the distance "b". If, for example drifting and blowing snow should pass through the through-holes 20, 21, it impinges on the opposite wall 18 onto a closed surface and not onto the through-holes 26, 27. Due to the disposition of the through-holes 20, 21, 26, 27 a type of labyrinth is formed. The entering air is deflected on its path into the interior of the roof, whereby the drifting snow is barred from entering into the interior of the roof. In order for water, which has penetrated through the through-holes 20, 21 into the venting channel 15, to be able to flow off again, it is recommended to allow the through-holes 20, 21 in the wall 17 to continue up to wall 16. This is indicated with the dashed lines 28, 29. However, it is also possible to provide between the through-holes 20, 21 and wall 16 separate openings in wall 17, which serve as water draining openings.

Figure 4A:
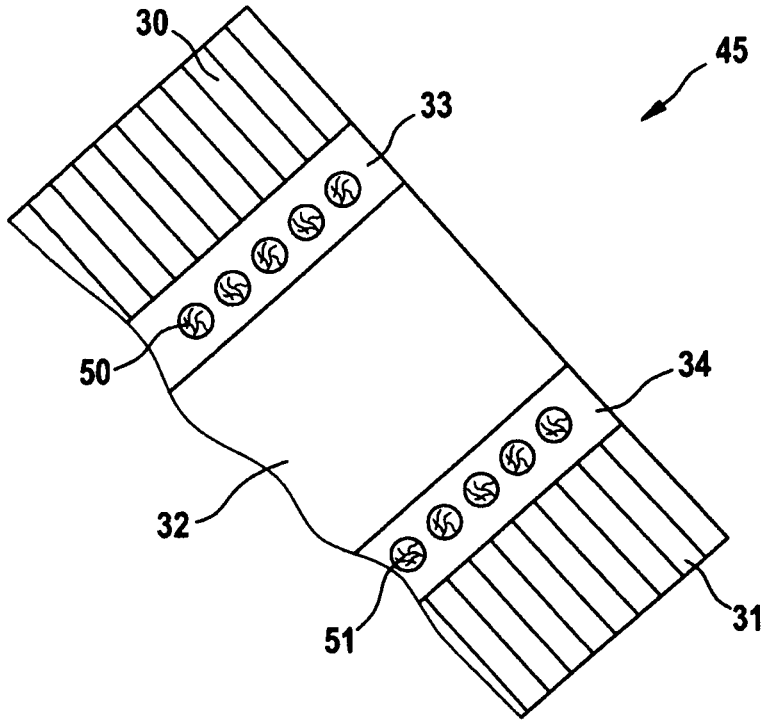

FIG. 4*a* shows another embodiment of a venting band 45 in top view. Again, two side strips 30, 31 are evident and a center strip 32. The regions 33, 34 of center strip 32 are such which are connected, for example adhered, with the side strip 30, 31 implemented in the form of waves. In the center strip 32, and specifically in the proximity of regions 33, 34, are provided through-holes 50 and 51, respectively, implemented as circular holes. Behind these through-holes 50 and 51, respectively, fabric material can be seen since the venting band 45 is compressed. In the compressed state it can be rolled up.

Figure 4B:
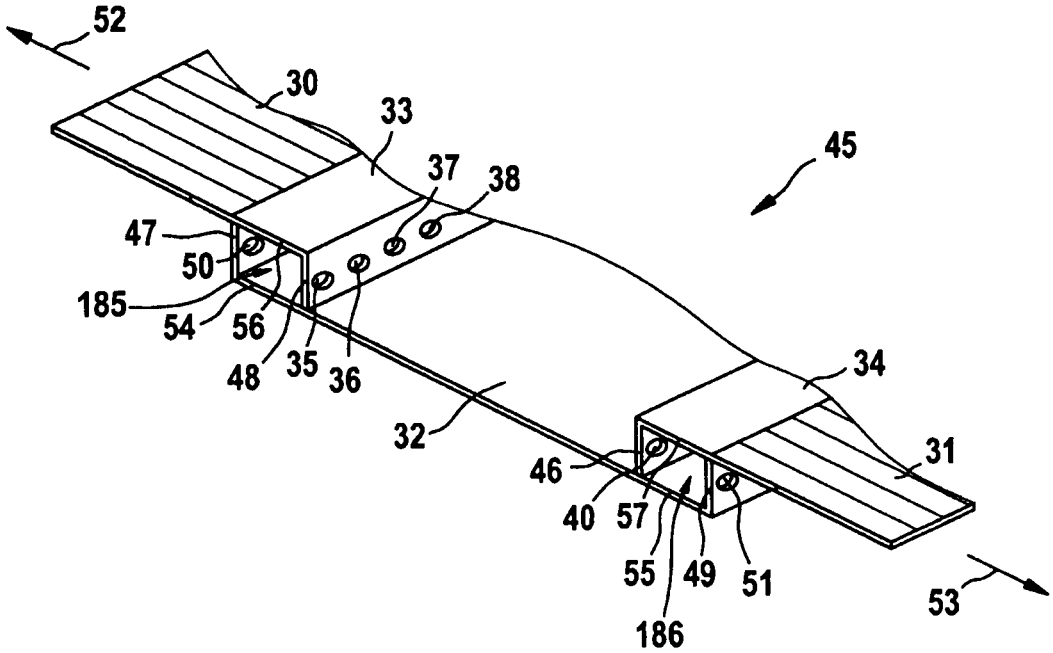

FIG. 4*b* shows the same venting band 45 as FIG. 4*a*, however, in a view from below, i.e. placed on its back. In this perspective illustration the venting band 45 is in the uncompressed state. This venting band 45 comprises two venting channels 185, 186 extending parallel to one another. Herein can be seen the through-holes 40 and 35 to 38 in walls 46 and 48 as well as the through-holes 50 and 51 in walls 47 and 49. Through-holes 35 to 39 and 40 to 44 were not yet evident in FIG. 4*a*.

If the side strips 30, 31 are pulled apart in the direction of arrows 52, 53, the form shown in FIG. 4*a* is obtained again. The through-holes 35 to 38 and 40 are then directly over the walls 54 and 55, respectively, while the through-holes 50, 51 are located directly opposite walls 56, 57.

Figure 5:
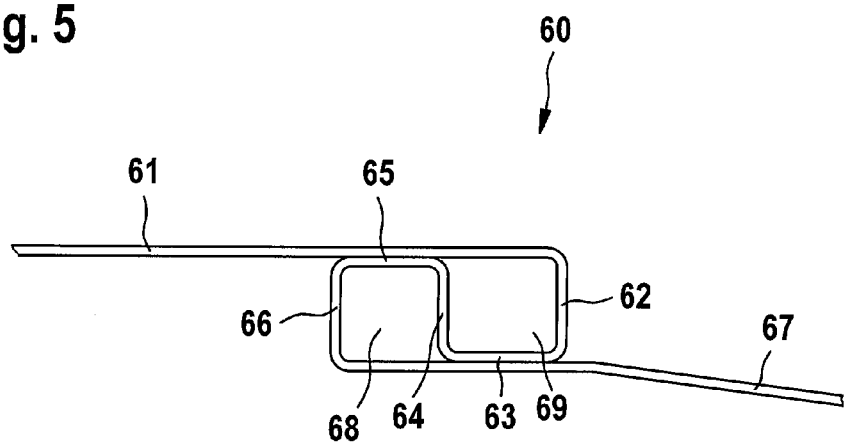

FIG. 5 shows the right half of a further embodiment example of a venting band 60 of non-divided flexible material, and specifically in a front view. It can be seen that the center strip 61 at its ends is bent downwardly and first forms wall 62, then wall 63, then wall 64, hereupon wall 65, subsequently wall 66 and lastly transitions over into a side strip 67. At the site at which the wall 65 rests on center strip 61 it is possible to establish a connection by welding or in any other manner. The same applies to the contact of wall 63 on the side strip 67. The through-holes in walls 62, 64, 66 are not visible in the illustration of FIG. 5.

In contrast to the preceding embodiment examples, the embodiment example of FIG. 5 comprises two venting channels 68, 69.

Figure 6:
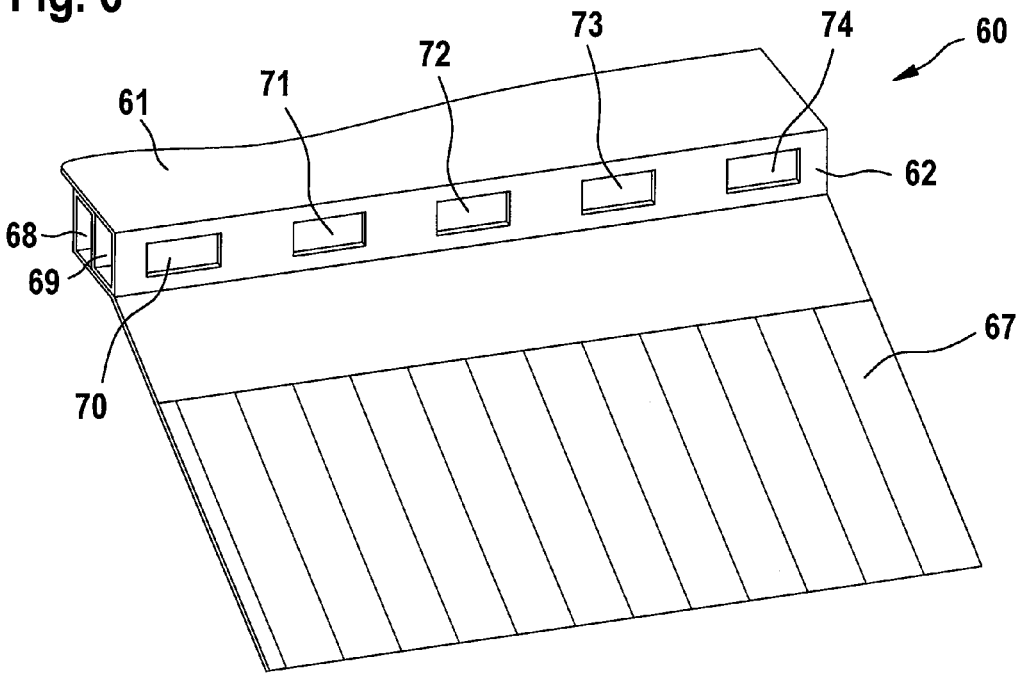

FIG. 6 shows the venting band 60 shown in FIG. 5 again from the side. Through-holes 70 to 74 in wall 62 can herein be seen.

Figure 7:
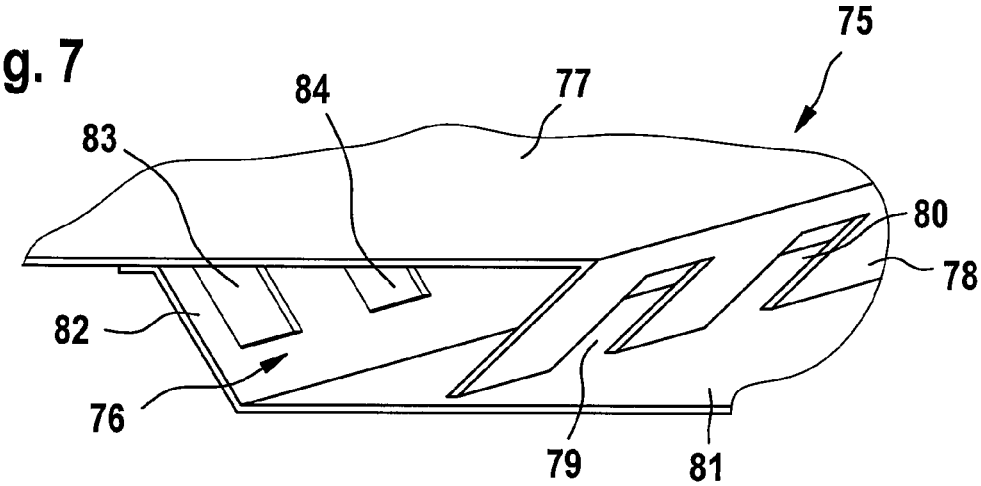

FIG. 7 shows a further variant of a venting band 75. The flexible venting band 75 comprises a venting channel 76, whose center strip 77 transitions over into an oblique wall 78 with through-holes 79, 80.

Conversely, the side strip 81 transitions over into an oblique wall 82 with through-holes 83, 84. The venting channel 76 has herein the cross sectional shape of a trapezoid.

Figure 8:
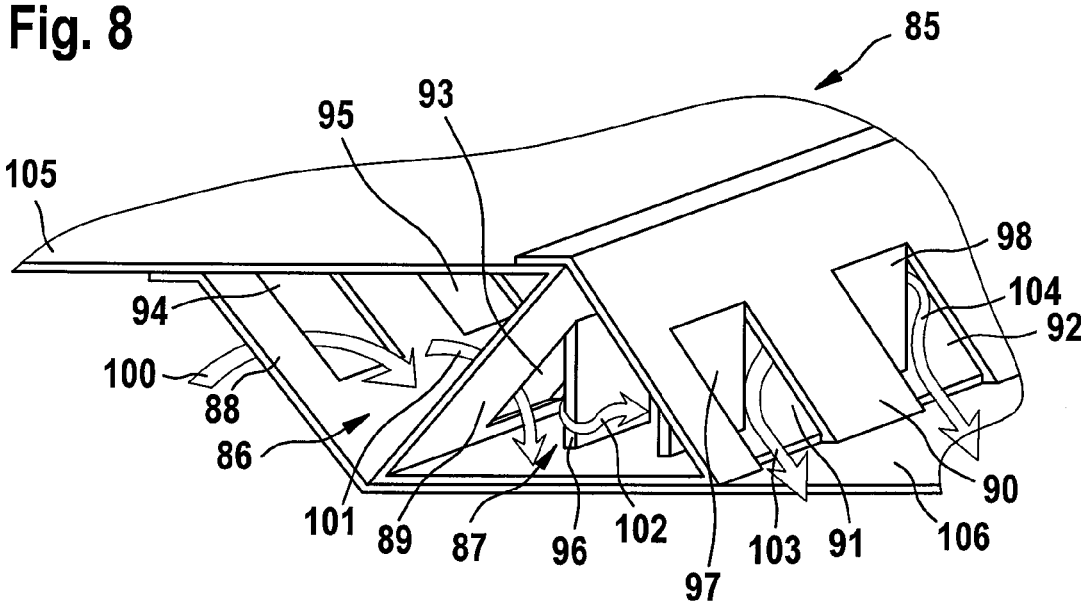

FIG. 8 depicts a further variant of a flexible venting band 85 with two venting channels 86, 87. The walls 88 to 90, which form the venting channels 86, 87, are herein placed obliquely such that they form triangles. Through-holes 91, 92 in wall 90 are evident as well as a through-hole 93 in wall 89 and two through-holes 94, 95 in wall 88. In venting channel 87 can additionally be seen obstructions 96 or 97 and 98, which are disposed behind the through-holes 93 or 91 and 92. Thereby a labyrinth is formed. The resulting air current is indicated by arrows 100 to 104. A center strip is denoted by 105, while a side strip is denoted by 106.

Figure 9:
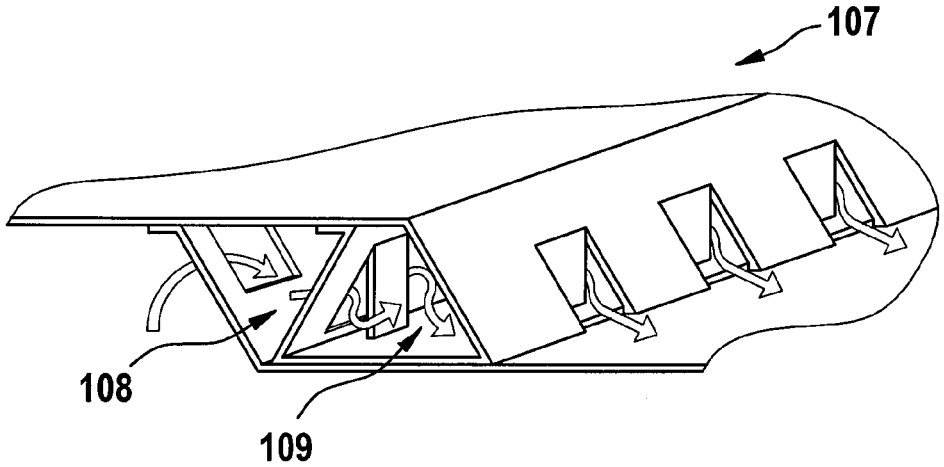

FIG. 9 shows a further venting band 107, which also comprises two venting channels 108, 109 and is structured similarly to the venting band 85.

Figure 10:
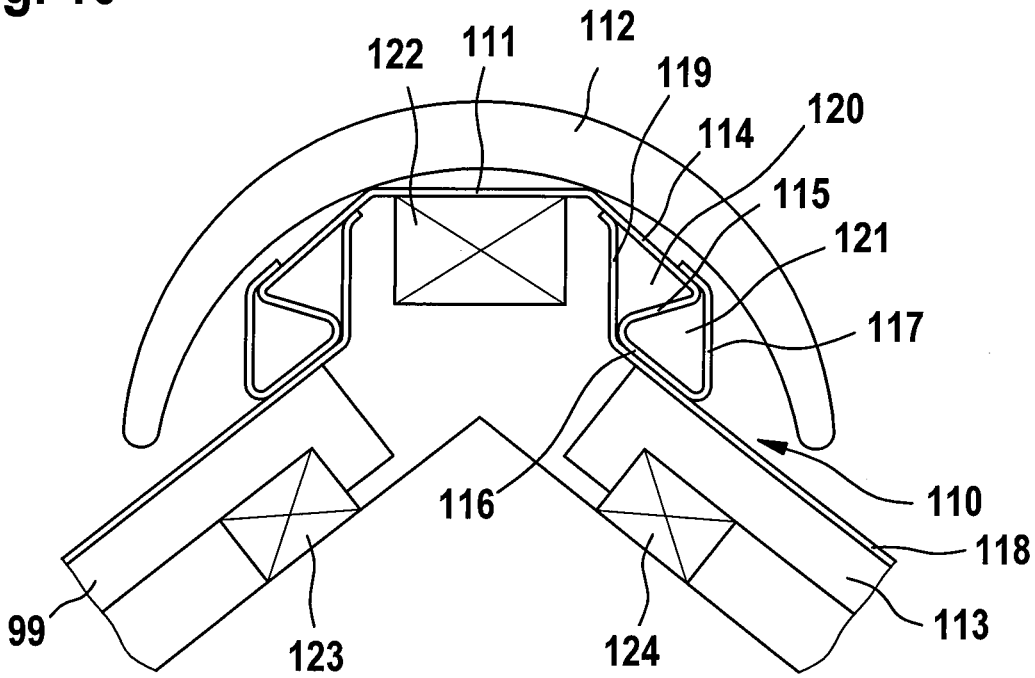

In FIG. 10 is shown a further venting band 110, which is laid in the ridge region of a roof. The center strip 111 is placed onto the ridge batten 122 and the venting band 110 is covered with a ridge roof tile 112. In the following the right half of the venting band 110 is described in further detail.

The center strip 111 forms a first straight piece 114, which subsequently extends at an angle of approximately 90 degrees to the left and forms a wall 115. Hereupon the center strip 111, after a turn to the right, extends toward the right parallel to the top side of the roof tile 113, forming a wall 116. After another left turn the center strip 111 forms a wall 117, and subsequently, after a further left turn, extends parallel to the straight piece 114. A side strip 118 extends initially parallel to the surface of the roof tile 113, then bends upwardly to abut the piece 114 of the center strip 111. Hereby a wall 119 is formed which, together with the straight piece 114 and the wall 115, forms a venting channel 120. A further venting channel 121 is formed by the walls 117, 115, 116. In walls 117, 115 and 119 are located through-holes, which are not visible in FIG. 10. By 122, 123 and 124 are denoted ridge battens, which support the roof tiles 112, 113 and 99. The left region of the venting band 110 shown in FIG. 10, is formed mirror-symmetrically to the right region and is therefore not described in further detail.

Figure 11:
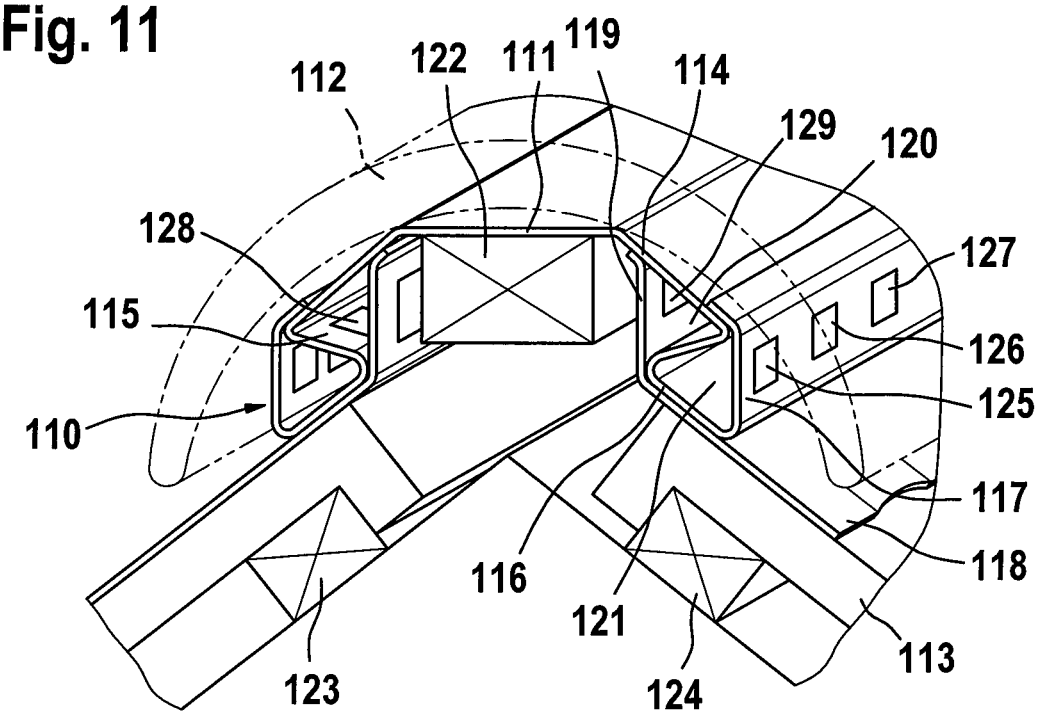

The depiction of FIG. 11 corresponds to the depiction of FIG. 10, except that it is a perspective view. Herein can be seen the through-holes 125 to 127 in wall 117, as well as a through-hole 128 in wall 115 and a through-hole 129 in wall 119.

The above used designation "venting channel" includes not only a venting channel 120 continuous in the longitudinal direction of venting band 110, but also an interrupted venting channel 120.

Figure 12:
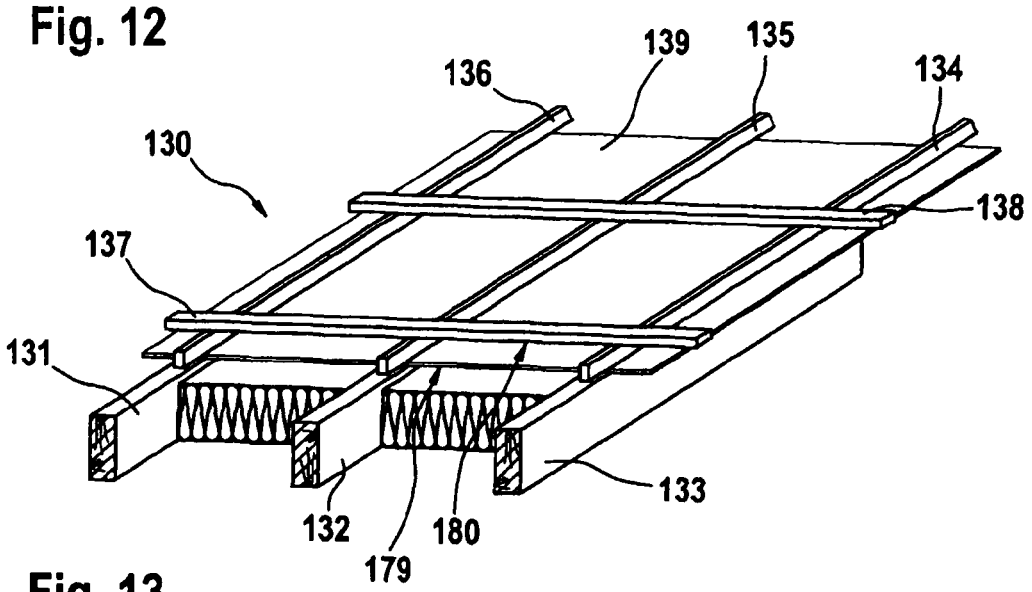

In FIG. 12 is depicted a segment from the eaves region 130 of a pitched roof. Evident are three parallel rafters 131 to 133 extending in the direction toward the ridge as well as counterbattens 134 to 136 fastened on the top sides of the rafters 131 to 133. Perpendicularly to the rafters 131 to 133 and the counterbattens 134 to 136 extend transverse battens 137, 138. Between the rafters 131 to 133 and the counterbattens 134 to 136 is located a sarking membrane 139.

Through this disposition two venting planes are formed, one lower venting plane 179 as well as an upper venting plane 180. Via the lower venting plane 179 melt water penetrated in or diffused through is discharged. The upper venting plane 180 supports the task of the lower venting plane 179 and, additionally, ensures the fast drying of the sarking membrane 139.

Figure 13:
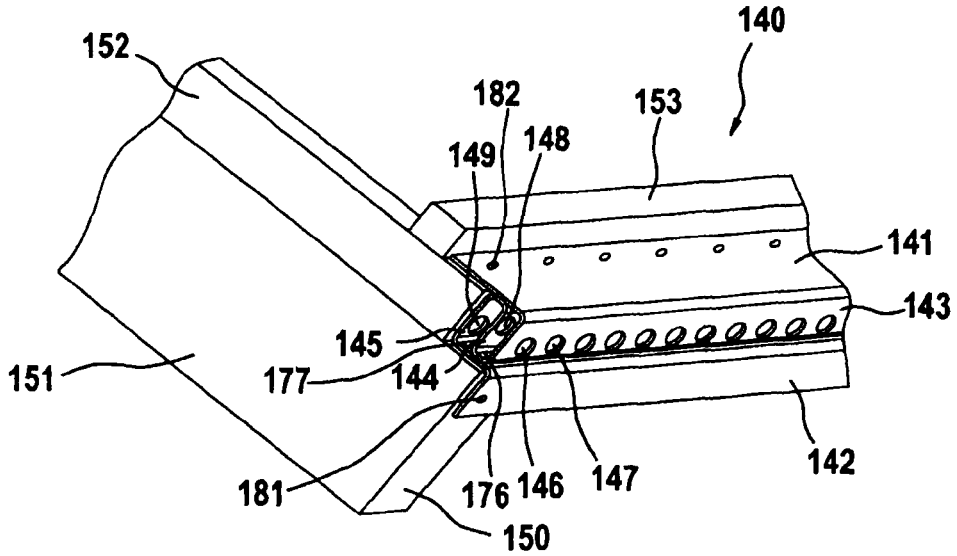

A segment from the eaves region 130 shown in FIG. 12 is shown in FIG. 13 and specifically together with a venting band 140. This venting band 140 is structured similarly to that half of the venting band 60 which is shown in FIG. 5. The side strips 141, 142, however, form here an angle of 90 degrees. In the walls 143, 144, 145 of venting band 140 through-holes 146 to 149 are provided extending parallel to one another. The one side strip 142 rests in contact on a front side 150 of a rafter 151, while the other side strip 141 rests on a counterbatten 152 and abuts a transverse batten 153.

FIG. 13 furthermore shows that the venting band 140 is connected with the counterbatten 152 and the rafter 151 across connection elements, of which only two are provided with the reference numbers 181, 182. These connection elements can be, for example, nails. While the venting band 140 can be adhered via its side strips 141, 142 with the rafter 151 or the counterbatten 152, it is, however, of advantage if the venting band 140 is additionally fastened via connection elements with the rafter 151 or the counterbatten 152, respectively.

The side strips 141, 142 can be comprised of only one material or also of several materials disposed one above the other.

This venting band 140 is comprised of a substantially flexible material. This venting band 140 can be comprised of an air-permeable or also of an at least partially air-permeable web material. This material can be film-like or fabric-like. As the fabric preferably an organic fabric is utilized. If the material is film-like, thin synthetic material films, metal foils or also organic films are utilized which have a thickness of up to approximately 1 mm. Depending on the type of material, the venting band 140 can be water-repellent or also at least partially water-permeable.

Thereby that the venting band 140 is comprised of a flexible material, it can assume two different states. In a first state, the compressed state, the venting channels 176, 177 are not open. This is the case when the venting band 140 is rolled up. In a second state, the uncompressed state, the venting channels 176, 177 are open. This occurs for example when rolling out the venting band 140. Through the use of certain materials for this venting band 140, the venting channels 176, 177 can open automatically when rolling out the venting band 140. This is the case, for example, when materials with restoring forces are utilized for the venting band 140.

Although in FIG. 13 rectangular venting channels 176, 177 are shown, it is also conceivable that the venting channels 176, 177 in the upright state have a different form in cross section. It is thus, for example, possible that the venting channels 176, 177 in the mounted state have a trapezoidal, triangular or also loop-shaped cross section. The through-holes 146 to 149 formed as holes, can also have different forms. Thus, the through-holes 146 to 149, for example, can be circular, rectangular, triangular or U-shaped. It is not absolutely necessary, as shown in FIG. 13, that the opposing through-holes 146 to 149 are offset with respect to one another. It is also conceivable that these through-holes oppose one another. If in the venting channels 176, 177 through-holes of different type are disposed, between these through-holes different types of water obstructions can be disposed. The through-holes can additionally be covered with an air-permeable fibrous web. While the through-hole herein remains air-permeable, however, the quantity of exchanged air is hereby less. This is in particular of advantage if an air channel is to be provided, which permits a lower air exchange without, however, changing the size of the through-holes. With the size of the through-holes remaining the same and the number of them remaining the same, the air exchange can be regulated without having to provide a new venting band. For this purpose, the fibrous web can, for example, be simply disposed on wall 143 such that it covers the through-holes implemented as venting holes 146, 147.

Figure 20:
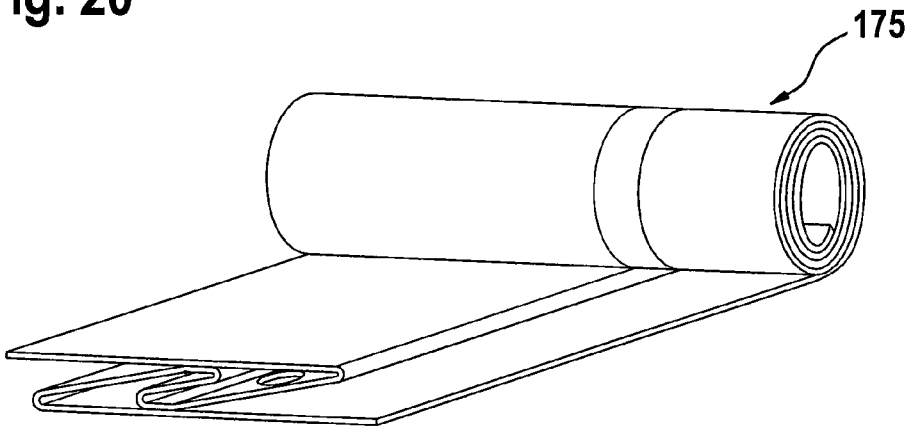

The venting band 140 depicted in FIG. 13 is supplied as a roll. In this state it is compressed, such that the walls of the venting channels 176, 177 are flat and in contact on one another and the venting channels 176, 177 are closed. A volume increase does not occur herein. Such a roll is shown in FIG. 20.

Figure 14:
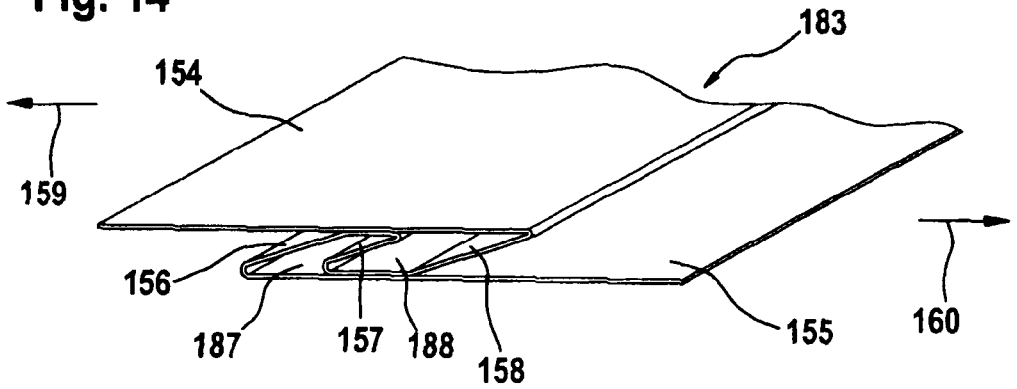

FIG. 14 shows a venting band 183 provided for the eaves region in the compressed state. A first side strip 154 and a second side strip 155 are evident. The walls 156 to 158 of the venting band 183 are folded over and extend nearly parallel to the side strips 154, 155. These walls 156 to 158 as well as the side strips 154, 155 can be comprised of a substantially flexible material. Between walls 156 to 158 two venting channels 187, 188 are disposed.

Figure 15:
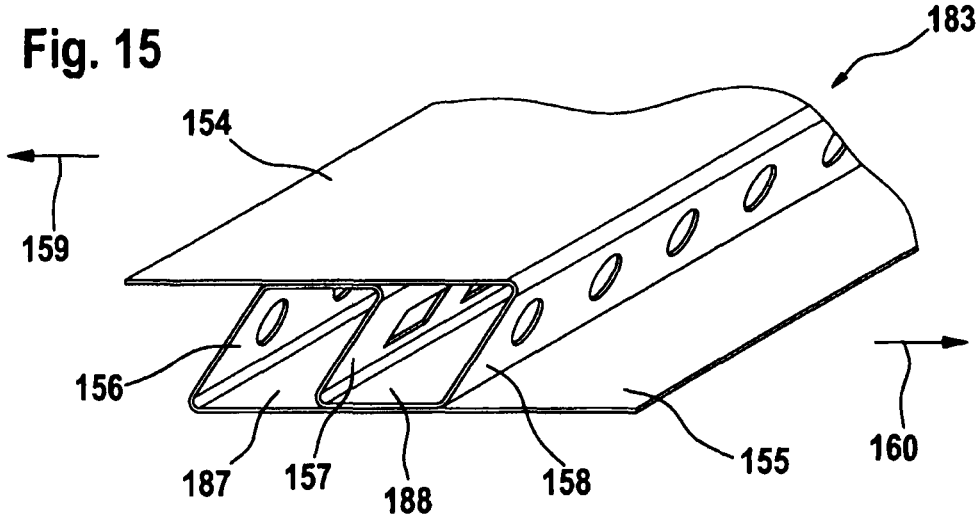
Figure 16:
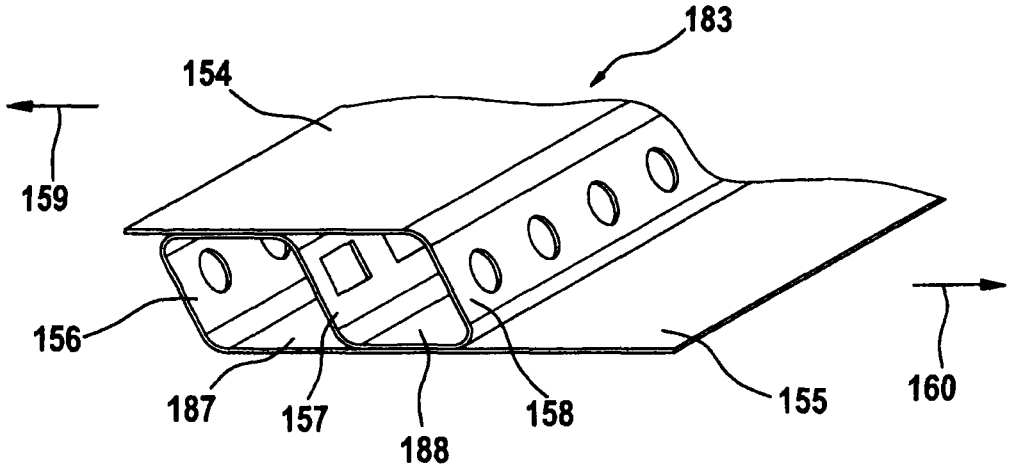

With the aid of forces acting according to the directions of arrows 159, 160 onto the first side strip 154 and the second side strip 155, rise the walls 156 to 158. With increasing extension in the transverse direction of the venting band 183, i.e. in direction 159 and in direction 160, approximately half of the maximum extension has been reached and the venting channels 187, 188 of venting band 183 are partially opened. This state can be seen in FIG. 15. In FIG. 16 the state of the venting band 183 after the maximum extension is shown.

The forces symbolized by arrows 159, 160 can be applied, for example by two hands.

This venting band 183 can be disposed, for example, in an eaves region of roofs.

Figure 17:
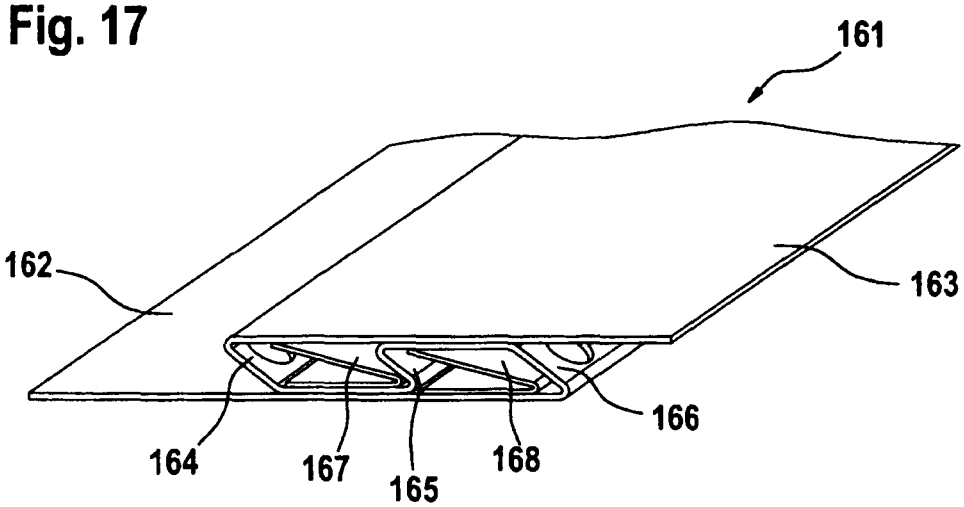

FIG. 17 shows a further venting band 161, in which the walls automatically upright themselves when the venting band 161 is wound off a roll. Between the strips 162, 163 walls 164 to 166 are disposed. Between two walls 164 to 166 each are located spring elements 167, 168, which exert forces onto the strips 162, 163, and specifically in the opposite direction.

These two venting channels disposed parallel to one another can be disposed one next to the other or also one above the other.

Figure 18:
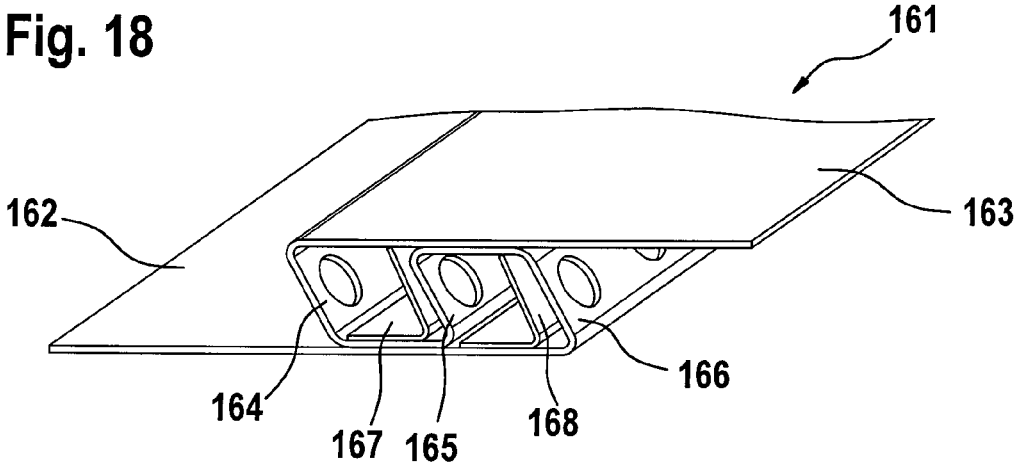

FIG. 18 shows the manner in which the walls 164 to 166 stand nearly perpendicularly on strips 162, 163 due to the forces exerted by the spring elements 167, 168.

Figure 19:
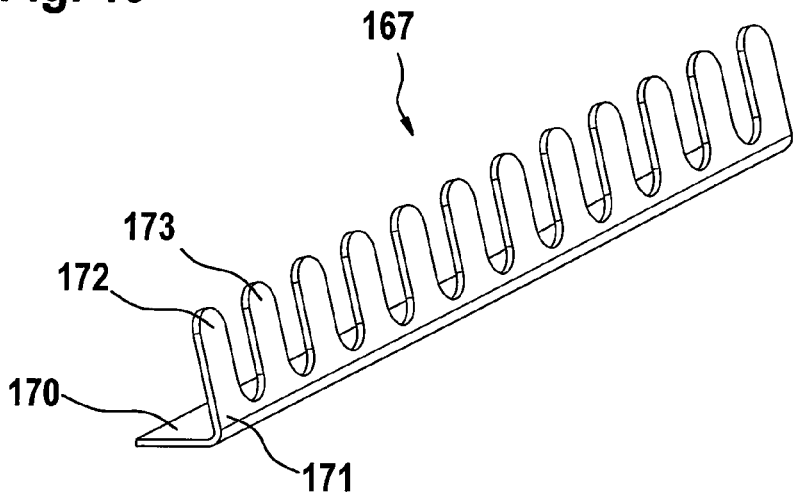

The spring element 167 is shown by itself in FIG. 19. It can be seen that it has two shanks 170, 171, which form an L. The one shank 171 has several prongs 172, 173, while the other shank 170 has a continuous surface. The spring element 167 is comprised of an elastically resilient material which, at the termination of the action of a force compressing the spring element 167, assumes its original position again.

In the compressed state, cf. FIG. 17, the venting band 161 can be wound up again into a roll. Through the process of rolling-out, sufficient forces are raised to compress the venting band 161. Consequently, only at the beginning of the formation of the roll does the end of the venting band 161 need to be compressed manually.

In FIG. 20 a roll 175 is shown, which is the wound-up venting band 140 according to FIG. 13. In this venting band 140 the side strip 141 is pressed against the side strip 142. Thereupon the unwinding can be started.

This roll 175 demonstrates that in the rolled-up state the though-holes 146 to 140 are closed, since the walls of the venting band 140 are largely compressed. In the rolled-up stage there are also no longer any venting channels, since these are also compressed.

Although particular embodiments have been described, many other variations and modifications and other uses will become apparent to those skilled in the art. Therefore, the present invention is not limited by the specific disclosure herein.

The invention claimed is:

1. A venting band for pitched roofs, comprising:

at least two side strips extending parallel to one another, and at least one venting channel extending parallel to the at least two side strips, wherein the at least one venting channel comprises a portion of the at least two side strips forming a pair of walls which contain first and second sets of through-holes respectively, wherein a labyrinth is formed in the at least one venting channel by either an offset disposition of the first and second sets of through-holes or by obstructions which are positioned behind said first and second sets of through-holes, the labyrinth thereby deflecting air entering one of said first and second sets of through-holes to follow a path defined by said labyrinth, said air not passing directly to the other set of said first and second set of through-holes, wherein the venting band can assume a first and second, wherein the first state is the compressed state, in which the at least one venting channel is compressed, whereby said first and second sets of through-holes are not opened, and wherein the second state is the uncompressed state, in which the at least one venting channel is not compressed and said first and second sets of through-holes are thereby opened, wherein between the at least two side strips is disposed a center strip, and wherein the at least one venting channel is provided between one of the at least two side strips and the center strip.

2. The venting band as claimed in claim 1, characterized in that the venting band in the first state is a roll.

3. The venting band as claimed in claim 2, characterized in that the at least one venting channel is configured to open automatically through installed restoring forces after the venting band is rolled out.

4. The venting band as claimed in claim 2, characterized in that the at least one venting channel is configured to be opened by pulling the venting band apart laterally.

5. The venting band as claimed in claim 1, characterized in that the venting band in the second state is rolled out.

6. The venting band as claimed in claim 5, characterized in that the venting band is comprised of a material which exerts restoring forces during rolling-out such that the venting channel uprights itself.

7. The venting band as claimed in claim 6, characterized in that the venting band is comprised of a material which brings about the restoring forces.

8. The venting band as claimed in claim 1, characterized in that the at least one venting channel uprights itself through an action of an external force onto the venting band.

9. The venting band as claimed in claim 1, characterized in that in the at least one venting channel are installed spring elements which bring about uprighting of the at least one venting channel.

10. The venting band as claimed in claim 1, characterized in that the venting band is comprised of a substantially flexible material.

11. The venting band as claimed in claim 1, characterized in that there are a plurality of the at least one venting channels, which are disposed one next to the other.

12. The venting band as claimed in claim 1, characterized in that there are a plurality of the at least one venting channels, which are disposed one above the other.

13. The venting band as claimed in claim 1, characterized in that the at least one venting channel in the second state has a rectangular cross section.

14. The venting band as claimed in claim 1, characterized in that the at least one venting channel in the second state has the form of a trapezoid in cross section.

15. The venting band as claimed in claim 1, characterized in that the at least one venting channel in the second state has a triangular cross section.

16. The venting band as claimed in claim 1, characterized in that the at least one venting channel in the second state has a loop-form cross section.

17. The venting band as claimed in claim 1, characterized in that the first and second sets of through-holes are circular holes.

18. The venting band as claimed in claim 1, characterized in that the first and second sets of through-holes are rectangular holes.

19. The venting band as claimed in claim 1, characterized in that the first and second sets of through-holes are U-shaped holes.

20. The venting band as claimed in claim 1, characterized in that the labyrinth is provided by a water obstruction provided between the first and the second sets of through-holes.

21. The venting band as claimed in claim 1, characterized in that the labyrinth is provided by a relative offset of the first and the second sets of through-holes.

22. The venting band as claimed in claim 1, characterized in that between the first sets of through-holes and the at least two side strips separate openings are provided.

23. The venting band as claimed in claim 1, characterized in that the second sets of through-holes are covered by a fibrous web with air permeability.

24. The venting band as claimed in claim 1, characterized in that the at least one venting channel comprises two venting channels, said two venting channels each being provided between the center strip and a respective one of the at least two side strips.

* * * * *

UNITED STATES PATENT AND TRADEMARK OFFICE

CERTIFICATE OF CORRECTION

PATENT NO. : 8,726,593 B2
APPLICATION NO. : 12/600968
DATED : May 20, 2014
INVENTOR(S) : Michael Krenz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 553 days.

Signed and Sealed this
Twenty-ninth Day of September, 2015

Michelle K. Lee

Michelle K. Lee
*Director of the United States Patent and Trademark Office*